US006424801B1

(12) United States Patent
Rabadi

(10) Patent No.: US 6,424,801 B1
(45) Date of Patent: Jul. 23, 2002

(54) UPRIGHT CYLINDRICAL WATER HEATER WITH TOP AND BOTTOM CAN COVERS

(75) Inventor: Masoud Rabadi, Northridge, CA (US)

(73) Assignee: Dynamo Aviation, Inc., Van Nuys, CA (US)

( * ) Notice: Subject to any disclaimer, the term of this patent is extended or adjusted under 35 U.S.C. 154(b) by 0 days.

(21) Appl. No.: 09/848,381

(22) Filed: May 2, 2001

(51) Int. Cl.[7] ..... F24H 1/18
(52) U.S. Cl. ..... 392/450; 392/486
(58) Field of Search ..... 392/450, 451, 392/453, 455, 465, 485, 486, 490, 497, 501

(56) References Cited

U.S. PATENT DOCUMENTS

| | | | | |
|---|---|---|---|---|
| 3,898,428 A | * | 8/1975 | Dye | 165/156 |
| 3,952,182 A | | 4/1976 | Flanders | |
| 4,185,187 A | * | 1/1980 | Rogers | 219/496 |
| 4,410,791 A | | 10/1983 | Eastop | |
| 4,567,350 A | | 1/1986 | Todd, Jr. | |
| 4,786,782 A | | 11/1988 | Takai et al. | |
| 5,129,034 A | | 7/1992 | Syndenstricker | |
| 5,388,179 A | | 2/1995 | Boyd, Jr. et al. | |
| 5,479,558 A | | 12/1995 | White, Jr. et al. | |
| 5,949,960 A | | 9/1999 | Hall | |
| 6,069,998 A | | 5/2000 | Barnes | |
| 6,080,973 A | | 6/2000 | Thweatt, Jr. | |
| 6,175,689 B1 | | 1/2001 | Blanco, Jr. | |

* cited by examiner

*Primary Examiner*—Teresa Walberg
*Assistant Examiner*—Thor Campbell
(74) *Attorney, Agent, or Firm*—Gene Scott; Patent Law & Venture GP.

(57) ABSTRACT

A miniature water heater apparatus has three water heating tubes joined in series interconnection and positioned in side-by-side adjacency. The water heating tubes are enclosed within a cylindrical container with opposing closed ends. A top and a bottom cylindrical covers are adapted for mounting over the top and bottom surfaces establishing a top and a bottom utility volumes. The top utility volume encloses an electrical control circuit providing logical control of the apparatus while the bottom utility volume provides access to the electrical resistance heaters and a temperature range switch. A wire access tube communicates between the opposing closed ends of the cylindrical container for providing circuit wire communication between the control circuit and the resistance heaters.

1 Claim, 1 Drawing Sheet

UPRIGHT CYLINDRICAL WATER HEATER WITH TOP AND BOTTOM CAN COVERS

BACKGROUND OF THE INVENTION

1. Field of the Invention

This invention relates generally to water heaters and more particularly to a compact water heater of novel construction.

2. Description of Related Art

The following art defines the present state of this field:

Flanders, U.S. Pat. No. 3,952,182 describes a miniature electric fluid immersion heater adapted for instantaneously heating relatively small bodies or flow increments of fluid to a predetermined temperature. The heater is particularly adaptable to be mounted immediately in advance of a hot water faucet in a home or building so as to provide a continuous flow of instantaneously heated water and thereby eliminate the standard hot water heater and the entire hot water piping system in the building. The heater comprises a small, cylindrical, thermally insulated pressure vessel having a fluid inlet and outlet as opposite ends. A series of individually actuated electrical heating elements are positioned within the vessel so as to be in intimate physical contact with the flowing fluid. The heating elements are constructed of a heavy gauge resistance element which is thinly coated with a glass or ceramic frit fused into an impervious, chemically resistant, electrically non-conductive coating having negligible thermal insulation and heat storage capabilities. The wire and coating preferably have matched thermal expansion characteristics so as to minimize stress on the coating. A control circuit for selectively activating the individual heating elements delivers electrical energy automatically responsive to demand. A flow sensor prevents the activation of the majority of the heating elements unless there is a flow of fluid through the heater. When a flow is present, the amount of electrical energy transferred to the fluid as it flows through the heater is controlled by automatic separate activation of the respective elements within the heater, the number of activated elements and their periods of activation being just sufficient to maintain a predetermined fluid temperature at the heater outlet.

Eastep, U.S. Pat. No. 4,410,791 describes an electric instant water heater mounted in a cold water line in proximity to a water tap includes an elongated core molded from a ceramic material and having a rectangular cross-section water flow passage extending therethrough from a circular inlet connected to a water supply pipe to a circular outlet connected to the water tap. A plurality of parallel, spaced, thin rectangular electrical resistance heating plates are positioned within the passage with one rolled edge of each plate being embedded in the core on one side of the passage way and the opposite rolled edge of each plate extending freely into the passage. A plurality of projections molded integrally with the core extend from the opposite side of the passage into the spaces between the heating plates and terminate short of the one side of the passage to define with the plates a serpentine flow path from the inlet to the outlet to cause water to be heated to flow across each face of the heating plates. The core is thermally insulated and a thermal overheat switch is provided to control energization of the heater plates.

Todd, Jr., U.S. Pat. No. 4,567,350 describes a compact instantaneous-type electric water heater for household and commercial use which provides hot water at a rate of at least five gallons per minute and includes a plurality of individual heating chambers connected in series flow relationship between a cold water inlet and a hot water outlet. A metallic mixing coil is disposed in series between each adjacent pair of chambers to promote even heating. The chambers are provided with electric heating elements having a combined wattage of at least thirty-thousand (30,000) watts. The heating elements are energized by a flow switch only at the time hot water is demanded and are controlled by an adjustable thermostat which sets the outlet water temperature and by a. high temperature safety switch limiting outlet water temperature should the thermostat fail. The heating elements are connected to the electrical utility system by contactor-type relays so that some of the heating elements are connected to the service side of the utility system while the others are connected to the building side of the system. An adjustable regulator is provided to assure that the water flow rate will not exceed the capacity of the heater to heat the water to a minimum acceptable level. The heater is enclosed in a sheet metal casing capable of being accomodated inside a standard wood wall between a pair of adjacent studs thereof.

Takai, et al, U.S. Pat. No. 4,786,782 describes an instantaneous water heater with enhanced temperature control and less variation in output water temperature having an output hot water pipe extending into a heating tank through the top thereof and surrounded by a coiled sheath electric heater for heating the water in the tank, the output pipe extending to the tank bottom and provided with an inlet thereat. An inlet pipe for water to be heated extends into the bottom of the tank and is throttled to provide an accelerated flow of incoming water away from the heater and outlet pipe toward an overheat prevention thermostat mounted externally on the top of the tank and connected to the heater. An output hot water temperature sensor located within the output water pipe adjacent the inlet thereof cooperates with a control unit of regulating operation of the heater to maintain the hot water output temperature at a preset level. The inlet to the water output pipe is throttled to insure mixing of the heated water, accurate temperature measurement and the reduction of scale deposition on the temperature sensor.

Sydenstricker, U.S. Pat. No. 5,129,034 describes an on-demand electric water heater including at least one heating chamber having an electric heating element operatively positioned between a cold water inlet and a hot water outlet. The heating elements are controlled by pressure sensing switches activated by water flow initiation or termination. A pressure relief valve is provided as a safety feature in the event the pressure sensing switches fail.

Boyd, Jr. et al, U.S. Pat. No. 5,388,179 describes a device for protecting a heating element in an electric water heater which consists of a sensor for sensing a predetermined amount of water that has entered the electric water heater and an electric circuit with a relay controlled by the sensor, for energizing the heating element when the predetermined amount of water is within the electric water heater and covering the heating element thereby preventing the burn out of the heating element; wherein the sensor has a float with electrical contacts that engage adjustable contacts set at a desired level to energize the heating element at a predetermined water level and includes an expandable seal mounted on the float preventing water from going above the float.

White, Jr. et al, U.S. Pat. No. 5,479,558 describes a very compact tankless water heater which delivers heat in proportion to demand. A flow responsive valve energizing an electrical control system is purely flow responsive, even to minute flow, and consumes no power when dormant. An uncomplicated electronic control system is connected to power by the flow switch, and is substantially deenergized when dormant. Most electronic components of the control system are mounted on the flat front wall of the pressure vessel. Thus, overall dimensions are minimized, cool water serves as a heat sink, and heat generated by electronic controls is captured for heating purposes. In particular, triacs controlling the heating elements are cooled, thus prolonging their life. A preferred embodiment of the novel heater has a maximum electrical consumption of 22 kilowatts, with equivalent heat output, and has overall external dimensions of 24 inches in height, 5.5 inches in width, and 4 inches in depth (61 cm in height, 14 cm in width, and 10 cm in depth). An outlet pipe fitting extending above adds approximately 2 inches (5 cm) to the overall height, enabling the water heater to be installed in a typical building interior wall or partition.

Hall, U.S. Pat. No. 5,949,960 describes multiple resistance type electric heating elements projecting into the interior of the storage tank portion of an electric water heater are protected against dry firing damage by using a water soluble member, representatively a sugar cube, positioned in the empty tank and blocking the spring-driven movement of a switch closure member that maintains an electrical circuit in an open state preventing electrical current flow through any of the heating elements. When the tank is initially filled with water the sugar cube dissolves, thereby unblocking the switch closure member and permitting it to be spring-driven into a circuit closing position to permit electrical current flow through the heating elements.

Barnes, et al, U.S. Pat. No. 6,069,998 describes a screw-plug type water heater having a heating element immersible in a water heater tank to heat water. Electrical terminals on the outer end of the heater connect the heating element into a heater circuit for a control unit (14). The control unit also includes a sensing circuit for the unit to be responsive to water temperature inputs to turn-on the heater to heat water to a desired temperature and maintain it there. A thermistor provides a temperature input to the control circuit. The thermistor is encapsulated in a bracket mounted in, or integrally formed with, the screwplug to sense water temperature. Terminals on the outer end of the heater allow the thermistor to be connected into the control circuit.

Thweatt, Jr., U.S. Pat. No. 6,080,973 describes an electric water heater which includes a polymeric body having an elongated hollow and an inlet opening and an outlet opening in communication with the hollow for flowing water to pass therethrough. An electrical resistance heater having a heating element of a material exhibiting a positive temperature coefficient of resistance is disposed in the hollow of the polymeric body and in heat transfer communication with water flowing through the hollow. An electrical source supplies electrical power to the heating element to generate heat. A controller senses current flow through the heating element and determines a resistance related value, such as current or resistance of the heating element. The controller also determines a first derivative of the resistance related value over time, and determines a second derivative of the resistance related value over time, and controls power supply to the heating element as a function of the first and second derivatives and/or absolute resistance.

Blanco, jr. U.S. Pat. No. 6,175,689 describes an improved "in-line" tankless electrical resistance water heater including a top having a cold water inlet and a hot water outlet for connection to the cold, and hot water lines of a faucet in a sink. The water heater includes a body with a passageway through which cold water travels, from the top towards the bottom, where it is fed into two separate chambers on opposed sides of a diaphragm. A first of the two chambers has no outlet, and the pressure of cold water therein presses against a first side of the diaphragm, while the second chamber includes an outlet to a further chamber having a heating element therein. The second chamber also includes a plunger, biased by a spring against a second side of diaphragm, and a plunger rod, which contacts an operating member of a microswitch. When a hot water handle of the faucet is opened, water travels from the further chamber to lower the cold water pressure in the second chamber and flex the resilient member toward the microswitch, to move the operating member and actuate the microswitch, so that the heating element is switched on. When the hot water handle is closed, the pressure in the two chambers will be equalized, and the spring will push the resilient member back to shut off the heating element.

The prior art teaches the use of high speed water heaters but does not teach the subject combination of construction features and related advantages as described in the following summary.

SUMMARY OF THE INVENTION

The present invention teaches certain benefits in construction and use which give rise to the objectives described below.

The present invention is a miniature water heater apparatus having plural water heating tubes. The water heating tubes each provide an electrical resistance heater which may be one leg of a 3 phase electrical power circuit. The water heating tubes are enclosed within a cylindrical container with opposing closed ends forming a top and a bottom surfaces of the apparatus and serving as a water reservoir. A top and a bottom cylindrical covers each have one closed end and are adapted for mounting over the top and bottom surfaces respectively with the closed ends of the covers directed away from the closed ends of the container, thereby establishing a top and a bottom utility volumes. The top utility volume engages an electrical control circuit providing logical control of the apparatus while the bottom utility. volume provides access to the electrical resistance heaters and a temperature range switch having a manual control extending downwardly from the bottom cover so as to enable manual access to operate the switch. A wire access tube communicates between the opposing closed ends of the cylindrical container for providing circuit wire communication between the control circuit and the resistance heaters.

A primary objective of the present invention is to provide an apparatus and method of use of such apparatus that provides advantages not taught by the prior art.

Another objective is to provide such an invention capable of small size.

A further objective is to provide such an invention capable of safe operation as is critically important in commercial aviation.

A still further objective is to provide such an invention capable of segregating possible water leakage from operating circuitry.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrates the present invention. In such drawings

DETAILED DESCRIPTION OF THE INVENTION

Figure 1:
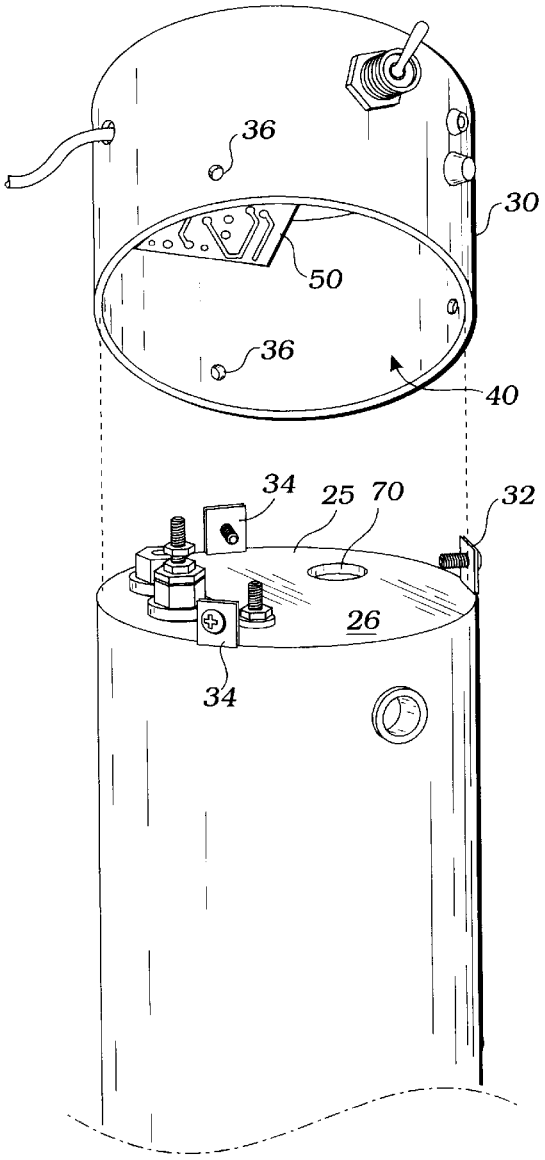
FIG. 1 is an exploded perspective view of a top portion of the invention and FIG. 2 is an exploded perspective view of a bottom portion of the invention.
Figure 2:
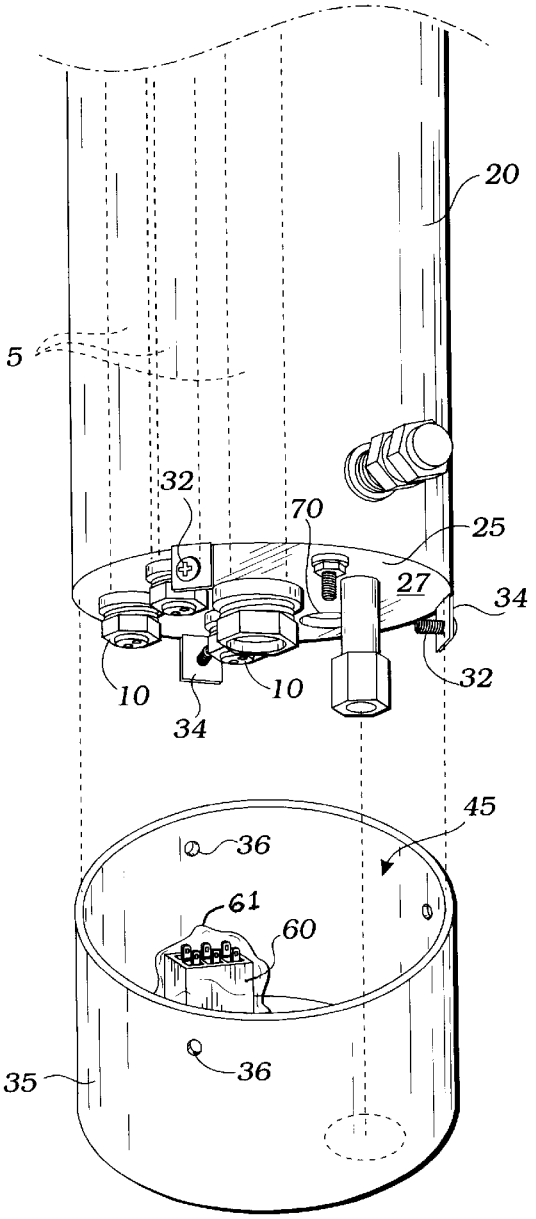

The above described drawing figures illustrate the invention in at least one of its preferred embodiments, which is further defined in detail in the following description.

The present invention is a miniature water heater apparatus for aircraft applications. As defined above, the apparatus is at once compact, capable of highly safe operation and easy to maintain as will be shown below. Three water heating tubes 5 are joined in series interconnection and positioned in side-by-side adjacency. The water heating tubes 5 each provide an electrical resistance heater 10 comprising one leg of a 3 phase electrical power circuit or a series or parallel single phase circuit. The water heating tubes are enclosed in a cylindrical container 20 with opposing closed ends 25 forming a top 26 and a bottom 27 surfaces of the apparatus. A top 30 and a bottom 35 cylindrical covers each have one closed end and are adapted, using screws 32, tabs 34 and holes 36 for mounting over the top and the bottom surfaces 26, 27 respectively with the closed ends of the covers 30, 35 directed away from the closed ends 25 of the container 20, thereby establishing a top and a bottom utility volumes 40, 45. The top utility volume 40 contains an electrical control circuit 50 for providing logical control for the apparatus. Located above the water container 20, the control circuit 50 is unlikely to become wet should water leakage occur. The bottom utility volume 45 provides access to the electrical resistance heaters 10 and a temperature range switch 60 having manual control means, such as the bat of a toggle switch (not shown) extending downwardly from the bottom cover so as to enable manual access. The temperature range switch 60 is enclosed in a waterproof encapsulation 61 so that water leakage cannot effect its operation. Wires are not shown. A wire access tube 70 communicates between the opposing closed ends 25 of the cylindrical container 20 providing circuit wire communication between the control circuit 50 and the resistance heaters 10 and the temperature range switch 60.

While the invention has been described with reference to at least one preferred embodiment, it is to be clearly understood by those skilled in the art that the invention is not limited thereto. Rather, the scope of the invention is to be interpreted only in conjunction with the appended claim.

What is claimed is:

1. A miniature water heater apparatus which comprises: up to three water heating tubes joined in electrical interconnection and positioned in side-by-side adjacency; the water heating tubes each providing an electrical resistance heater comprising an electrical power circuit; the water heating tubes enclosed in a cylindrical container with opposing closed ends forming a top and a bottom surfaces of the apparatus; a top and a bottom cylindrical covers each having a closed end are adapted for mounting over the top and bottom surfaces respectively with the closed ends of the covers directed away from the closed ends of the container thereby establishing a top and a bottom utility volume, the top utility volume engaging an electrical control circuit for providing logical control of the apparatus; a bottom utility volume providing access to the electrical resistance heaters and an encapsulated temperature range switch having manual control means extending downwardly from the bottom cover enabling manual access; and a wire access tube communicating between the opposing closed ends of the cylindrical container for providing circuit wire communication between the control circuit and the resistance heaters and temperature range switch.

* * * * *